US011629945B2

(12) United States Patent
Helge

(10) Patent No.: US 11,629,945 B2
(45) Date of Patent: Apr. 18, 2023

(54) SYSTEM, IN PARTICULAR HAND GRENADE

(71) Applicant: Rheinmetall Waffe Munition ARGES GmbH, Storf/Schwanenstadt (AT)

(72) Inventor: Graf Helge, Österreich (AT)

(73) Assignee: Rheinmetall Waffe Munition ARGES GmbH, Rüstorf/Schwanenstadt (AT)

( * ) Notice: Subject to any disclaimer, the term of this patent is extended or adjusted under 35 U.S.C. 154(b) by 0 days.

(21) Appl. No.: 16/924,383

(22) Filed: Jul. 9, 2020

(65) Prior Publication Data

US 2021/0018306 A1 Jan. 21, 2021

(30) Foreign Application Priority Data

Jul. 15, 2019 (EP) ..... 19186279

(51) Int. Cl.

| | |
|---|---|
| ***F42C 15/184*** | (2006.01) |
| ***F42C 15/192*** | (2006.01) |
| ***F42C 14/02*** | (2006.01) |
| ***F42B 27/00*** | (2006.01) |
| ***F42B 39/14*** | (2006.01) |

(52) U.S. Cl.

CPC ..... *F42C 15/184* (2013.01); *F42B 27/00* (2013.01); *F42B 39/14* (2013.01); *F42C 14/02* (2013.01); *F42C 15/192* (2013.01)

(58) Field of Classification Search

CPC ..... F42B 27/00; F42B 39/14; F42C 14/02; F42C 15/184; F42C 15/192; F42C 15/18; F42C 15/188

USPC ..... 102/256

See application file for complete search history.

(56) References Cited

U.S. PATENT DOCUMENTS 3,498,223 A * 3/1970 Andersson ..... F42C 15/20 102/221
3,505,959 A * 4/1970 Hans ..... F42C 14/02 102/487
3,618,522 A * 11/1971 Henderson ..... F42C 14/02 102/222

(Continued)

FOREIGN PATENT DOCUMENTS

CH 390 092 A 3/1965
CH 713239 A2 * 6/2018 ..... F42C 14/02

(Continued)

OTHER PUBLICATIONS

EP search report in EP 19 18 6279 (Year: 2019).*
EP opinion in EP 19 18 6279 (Year: 2019).*

*Primary Examiner* — James S Bergin
(74) *Attorney, Agent, or Firm* — Harness, Dickey & Pierce, P.L.C.

(57) ABSTRACT

In order to improve safety, particularly during transportation and/or storage, a system (10) is proposed which at least comprises a housing (13) an explosive (3) held therein which is initiated by a blasting cap (1), wherein a sleeve insert (2, 2') in the housing (13) makes it possible for the blasting cap (1) to be removed from the explosive (3), in that the blasting cap (1) in the sleeve insert (2, 2') is height-adjustable, so that the position of the blasting cap (1) relative to the explosive (3) can be changed. The system (10) may include a fuse head (11) which at least comprises a primer cap and possibly a delay line (14). The blasting cap (1) may be an integral part of the fuse head (11) and insulated therewith on the base.

13 Claims, 3 Drawing Sheets

(56) References Cited

U.S. PATENT DOCUMENTS

| | | | | |
|---|---|---|---|---|
| 3,683,814 | A * | 8/1972 | Bedall | F42C 14/02 102/265 |
| 5,355,803 | A * | 10/1994 | Robinet | F42C 14/02 102/254 |
| 6,792,868 | B2 * | 9/2004 | Teilhol | F42C 14/02 102/482 |
| 8,408,134 | B2 * | 4/2013 | Sibum | F42C 15/188 102/272 |
| 2003/0167953 | A1 | 9/2003 | Teilhol et al. | |

FOREIGN PATENT DOCUMENTS

| | | | |
|---|---|---|---|
| DE | 116787 | C | 8/1899 |
| DE | 10 2009 059 951 | B4 | 5/2012 |

* cited by examiner

SYSTEM, IN PARTICULAR HAND GRENADE

CROSS REFERENCE TO RELATED APPLICATION

This application claims priority to European Patent Application No. 19186279.6, filed on 15 Jul. 2019, the disclosure of which is incorporated herein by reference in its entirety.

FIELD

The invention relates to a system, in particular a hand grenade. The invention particularly focuses on a mechanical interruption of an ignition chain in the system under the influence of heat on the system.

BACKGROUND

A missile, in particular a hand grenade, is disclosed in DD 25 092 A5. This comprises a metal tube into which a delay composition is screwed. A blasting cap is attached to the lower end of the delay composition. A plastic explosive which is initiated by the blasting cap is used as the explosive.

DE 601 08 055 T2 is situated in the technical field of devices for the detonation of a pyrotechnic charge, in particular for a hand grenade, in this case of delay action means for the pyrotechnic initiation of a pyrotechnic chain. Pyrotechnic delay elements in this case are defined as elements of the pyrotechnic chain which detonate an explosive charge after they have burned through. A similar method involves replacing the explosive or booster charge with a detonator which guarantees continuation of the ignition of the pyrotechnic chain. The detonator is included in a rotor which can pivot due to an external impact and thereby closes the ignition chain.

A further pyrotechnic ignition chain interruption of a hand grenade fuse is described in DE 10 2009 059 951 B4. The hand grenade fuse comprises a primer cap, a delay composition ignited by the primer cap in a delay composition receiving means and a detonator to be ignited by the delay composition in a detonator holder. If the primer cap should be inadvertently ignited, it is guaranteed that the delay composition receiving means is secured in a first position, so that it cannot adopt a second position. In this way, the obstruction of the pivoting movement of the detonator holder is maintained and the delay composition cannot ignite the detonator.

Furthermore, linear, thermally activated systems are known in the art which have a negative effect on the amount of explosive that can be used in the grenade, particularly due to their size.

The mechanical components, which are highly complex for the most part, have a high degree of fallibility. A further fault influence that cannot be ignored is the costly sealing of the pyrotechnic interfaces in respect of environmental influences.

In addition, detonator systems are known in the art which, on account of their technology, do not have any explosive force without external insulation of the detonator wall and become capable of detonation with insulation from outside. These special explodable systems are relatively large and expensive by comparison with conventional detonators.

SUMMARY

The problem addressed by the invention is that of improving safety during the transportation and/or storage of a system containing a blasting cap, in particular of hand grenades. Hand grenades should also be prevented from being detonated if there should be a fire.

The problem is solved by the features of Patent Claim 1. Advantageous embodiments can be inferred from the dependent claims.

The problem on which the invention is based is that of installing a mechanical ignition interruption in the system, i.e. to provide an active interruption of the blasting cap or the detonator from the explosive. In this way, a pyrotechnic ignition chain between the blasting cap and the explosive is interrupted. A hand grenade, for example, is defined as the system for this purpose.

DE 10 2017 108 938 A1 describes an irritant device having means for adjusting effective power. The focus is directed at achieving an individual adjustment possibility for the number of active compositions locally. A switching mechanism encloses a pipe with bores and grooves incorporated around the circumference which create a connection to the chambers provided in each case through adjustment of the switching mechanism. In a particular embodiment, the switching mechanism contains the delay charge. It is thereby achieved that the delay charge has no contact with the chambers when in a secured position. This design offers the advantage that the storage of irritant devices of this kind is more reliable, since the connection between the delay composition and the effect charge is interrupted during storage with none of the bores coming into contact with a chamber.

According to the invention, the blasting cap or the detonator can be moved within the system from a safe position into a live position, and vice versa. The blasting cap is separated spatially or locally from the explosive for safe positioning. To make the system live, the blasting cap is moved into the active region of the explosive. If the system is no longer needed, the blasting cap can be moved back into the safe position. This means that the system can also be returned to the safe position.

Returning a system of the same kind to a safe position is described in DE 10 2010 021 685 B4. The mechanism comprises a moulded part which has a bolt which can engage with a receiving means in the rocker lever and explosive device housing. In addition, a profile is incorporated which prevents a release in the locking position. This profile may be a ratchet profile on the profile part which interacts functionally with a further means on the explosive device.

The present system has a sleeve insert (cavity). The sleeve insert is preferably cylindrical and is internally preferably hollow. The sleeve insert can delimit the explosive. The sleeve insert is open at its upper side but closed on the bottom. It contains the separating medium. In addition, the sleeve insert is preferably formed from a plastic. Plastic can be used as a braking medium.

The blasting cap can be introduced into this sleeve insert. The blasting cap, for its part, is movable within the sleeve insert of the system housing in a height-adjustable manner. In the safe state, functionality of the blasting cap with the explosive is prevented, even if the blasting cap were to be initiated. In the live state, functionality between the blasting cap and the warhead is deliberately set. In the live state, an effective power of the system can also be deliberately set.

In a preferred embodiment the sleeve insert may be incorporated in the system housing in such a manner that a modular unit can be created. The sleeve insert, explosive and housing can thereby create a lower module.

A fuse head may be introduced into this module. The lower module has a receiving means for the fuse head for this purpose. This may be provided with a rocker lever. The fuse head may be inserted into the receiving means, e.g. via a screw connection.

The fuse head also comprises a primer cap. In a preferred embodiment, a delay line is incorporated in the fuse head between the primer cap and the blasting cap. The blasting cap is preferably an integral part of the fuse head and can be insulated therewith on the base of the delay line. The fuse head, primer cap, possibly the delay line and the blasting cap may, for their part, form an upper module in a preferred embodiment.

An irritant device has already been proposed in DE 10 2010 052 210 A1 which is formed from at least two modules. An upper module is used for receiving a fuse head with a rocker lever and contains upper blowout openings. A lower module is intended to receive an effect charge. The two modules can be connected to one another.

A detonation wave interruption or a detonation wave weakening can be achieved through suitable separating media. A suitable separating medium, in this case air, for example, is used as the main brake medium of the detonation wave.

Alongside suitable separating media, a detonation wave interruption or weakening can also be achieved through suitable spacings within the system. For this purpose, the space between the blasting cap and the explosive can be varied, for example. The variation in spacing takes place through an adjustment of the blasting cap at the height of the sleeve insert. Particularly through a movement of the fuse head itself, a localized or spatial change in position of the blasting cap in relation to the sleeve insert can be undertaken. The system can be changed from a safe state into a live state, and vice versa, through this positional change of the blasting cap.

In the safe state, the blasting cap is preferably located completely outside the sleeve insert. The sleeve insert in this case only holds the separating medium, e.g. air. It is thereby ensured that a possible detonation wave cannot take effect on the explosive. A possible detonation wave to the explosive is interrupted.

In the live (armed) state, a reinforcement of the detonation waves of the blasting cap can be created through suitable structural measures in the system. A reinforcement of the detonation wave of the blasting cap in the armed state can also be achieved through mechanical measures, e.g. through a positional change of the blasting cap in the system. If the blasting cap is located entirely within the sleeve insert, an optimization of the detonation wave is usually set. The detonation wave can be weakened by the blasting cap being removed from the active region of the explosive once again until the blasting cap leaves the sleeve insert again and the system is in the safe state.

This controllability of the initiating power is, for example, also achievable through a radial and axial weakening of the detonation transmission efficiency of the blasting cap below the deflagration threshold of the explosive.

As a further structural measure for reinforcing the detonation wave, it may be provided that the sleeve insert exhibits a kind of constriction on the base side or in the base region. This may be smaller in diameter than the diameter of the sleeve insert. The cross section of this constriction may be round, oval, square, etc. A conical, truncated conical, pyramid-shaped but also cylindrically shaped constriction is possible in this case. The blasting cap and the sleeve insert should be geometrically adjusted to one another. In this way, a centring of the blasting cap in the end region of the sleeve insert can also be achieved.

An additional efficiency increase of the blasting cap or the detonator can be achieved if an upper insulation with a delay tube of the delay line and fuse is provided. Furthermore, controllability of the initiating efficiency below as well as above the deflagration limit of the explosive is also feasible.

A permanent connection is provided between the fuse head and the system housing during adjustment of the fuse head, for example, and associated with this, the blasting cap within the sleeve insert in relation to the detonation waves to the explosive. Alternatively, the fuse head may, however, also be completely turned out of the system housing.

Conventional blasting caps can be used in the invention; there is no need for special blasting caps. The blasting caps can be integrated into existing systems. A standard explosive can also be used. This allows for use in standard explosive devices or traditional hand grenades. No seals are required for the parts which are movable in respect of one another. A major advantage lies in the fact that the interruption of the ignition chain is not achieved through interference with the pyrotechnics.

The blasting cap has a compact structural form and a simple mechanism. The system body and fuse head need not be packed separately. The system can be armed directly for use. When not in use, the live system can be returned to a safe state, the disarmed state. It is not therefore possible for the fuse head to be armed without the system being activated beforehand. Transformation of the system body during the triggering of the blasting cap in the safe state is impossible.

In order to improve safety, particularly during transportation and/or storage, a system is proposed which at least comprises a housing and the explosive held therein. This is initiated by the blasting cap. A sleeve insert in the housing makes it possible for the blasting cap to be removed from the explosive, in that the blasting cap in the sleeve insert is height-adjustable, so that the position or spacing of the blasting cap relative to the explosive can be changed. This structural solution makes it possible for the system to be transported and stored in the safe state. A further advantage that can arise during this is that the system can be changed locally from a safe and activated state and from this back into a safe state.

A pressure element is attached between the fuse head and the housing. The pressure spring which is installed in addition ensures a guaranteed separation of the blasting cap and possibly the delay element from the explosive, particularly under the influence of heat caused by fire, since the functionality and strength of plastics can no longer be guaranteed when under the influence of intense heat. This principle functions on the basis of a slow influence of heat from the outer layers of plastic inwards and presses the ignition elements or the fuse head actively out from the explosive device (housing) following the softening of the outer (screw) connections. This means that an approximation of the blasting cap to the explosive is ruled out.

BRIEF DESCRIPTION OF THE DRAWINGS

The invention is to be more closely illustrated with the help of exemplary embodiments and the drawing. The basic principle of the invention is considered more closely in this case. Sizes of the individual components, or the like, cannot be inferred from these exemplary embodiments. In the figures.

DETAILED DESCRIPTION

Figure 1:
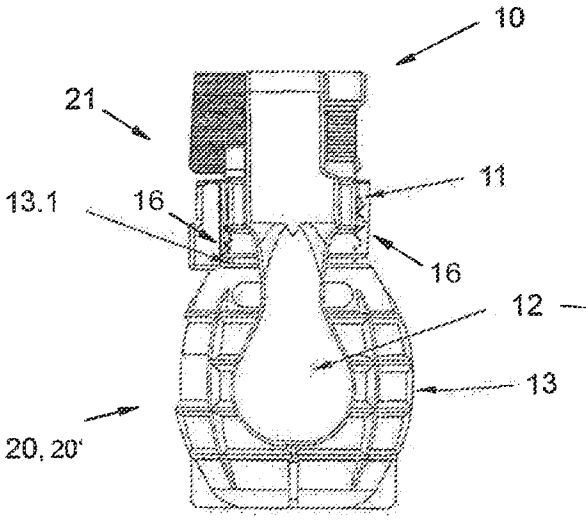
FIG. 1 shows a system according to the invention.

In FIG. 1, a system—in this case a hand grenade—is identified using 10. The system 10 at least comprises a fuse head 11. A lever 12, for example a rocker lever, may be attached to the fuse head 11. The system 10 also has a housing 13. The housing 13 has an opening 13.1 for receiving the fuse head 11. The fuse head 11 can be screwed into the housing 13, for example, via a connection 16. At least the (screw) connection 16 between the fuse head 11 and the housing 13 is based on a material made of plastic.

Figure 2:
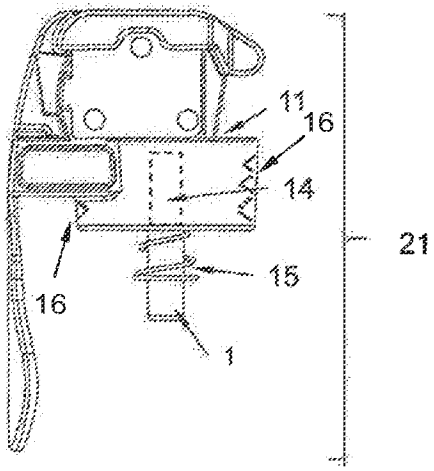
FIG. 2 shows the fuse head from FIG. 1.

FIG. 2 shows the fuse head 11 from FIG. 1. The fuse head 11 comprises a primer cap which is not depicted in greater detail and has at least one blasting cap 1 on the base side. In a preferred embodiment, the fuse head 11 also has a delay line which can be created in a manner known in the art by a delay composition in a delay composition receiving means 14, e.g. a delay tube. The blasting cap 1 can then be attached to this delay tube 14 on a lower base surface. The blasting cap 1 is preferably insulated with the base area of the delay tube 14. In the region of the blasting cap 1, a pressure element 15, e.g. a pressure spring, is attached on the circumferential side below the fuse head 11.

The housing 13 of the system 10 is filled with an explosive 3. The housing 13 also receives a sleeve insert 2. The explosive 3 can be delimited by the sleeve insert 2.

The deflagration limit of the explosive 3 used determines the necessary combustion pressure which is required in order to create a necessary deflagration wave to initiate the explosive 3. Accordingly, the detonation transmission can be weakened by suitable separating media and/or spacings, so that an initiation of the explosive 3 does not take place. Using these measures, individually or in combination, an interruption or weakening of the detonation wave acting on the explosive 3 can be created. In this way, a safe state can also be set.

Figure 3A:
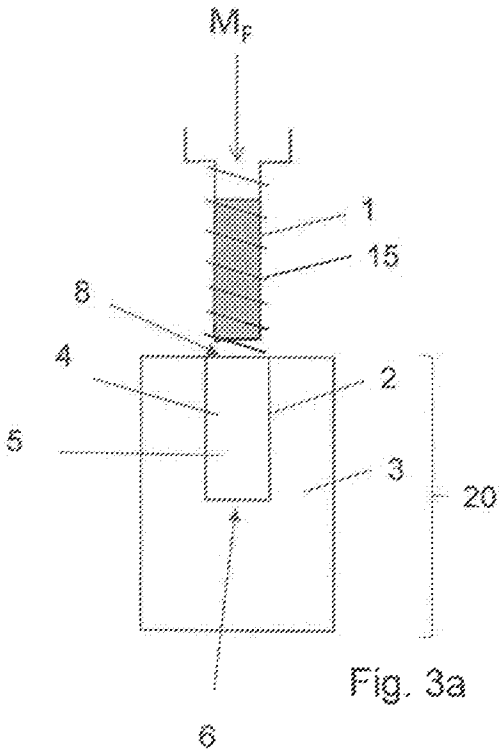
FIGS. 3*a*, 3*b* and 3*c* show a sketched depiction of a first embodiment of the invention.
Figure 3B:
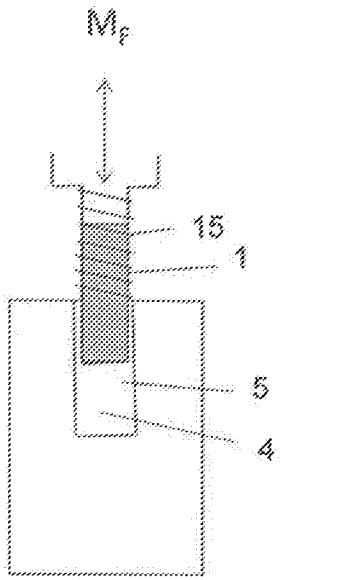
Figure 3C:
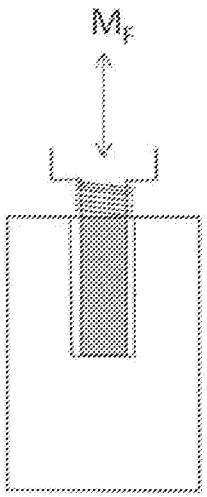

In a first embodiment according to FIGS. 3*a*-3*c*, the sleeve insert 2 is configured cylindrically with a flat base 6 and has an opening 8 opposite this base 6. The sleeve insert 2 has a hollow or empty space 5. A separating medium or separating means 4, e.g. air, can be introduced in said space. The blasting cap 1 can be moved into and out of the sleeve insert 2. The blasting cap 1 is arranged within the sleeve insert 2 in a height-adjustable manner for this purpose.

The safe state of the system 10 is depicted in FIG. 3*a*. The blasting cap 1 is located outside the sleeve insert 2 and is not therefore in contact with the explosive 3. An initiation of the blasting cap 1 by the delay charge does not lead to an initiation of the explosive 3. A deflagration wave which forms cannot reach the explosive 3. This variant has the advantage that an unwanted initiation of the explosive 3 can be definitively precluded.

FIG. 3*b* shows a first armed or live state of the system 10. The blasting cap 1 is located at least partially in the sleeve insert 2. The blasting cap 1 in this case interacts functionally in a known manner with the explosive 3 in the system 10. An ignition of the blasting cap 1 by the delay charge causes the initiation of the explosive 3 during closure of the ignition chain.

Optimization of the initiating power is achieved when the blasting cap 1 has been completely moved into the sleeve insert 2 (FIG. 3*c*).

Figures 4A, 4B, 4C:
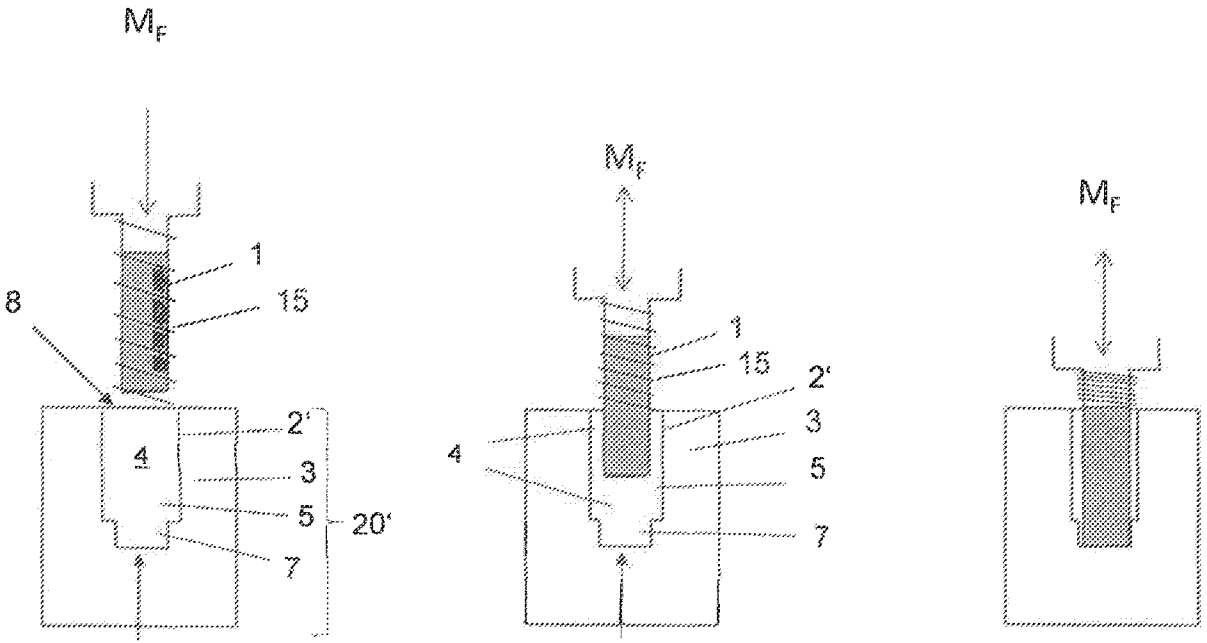
FIGS. 4*a*, 4*b* and 4*c* show a sketched depiction of a second embodiment of the invention.

FIGS. 4*a*-4*c* show a further embodiment. A lower end region of the sleeve insert 2' has a shoulder 7 in the form of a constriction. A base 6' of the sleeve insert 2' has a smaller diameter than the sleeve insert 2' itself. In order to centre the blasting cap 1 in the sleeve insert 2', this tapering or constriction can be used at least to support the orientation within the sleeve insert 2'. The constriction 7 may have a uniform geometric shape like the sleeve insert 2', but it may also differ therefrom. The blasting cap 1 and at least the end region, i.e. the constriction 7 of the sleeve insert 2' should, however, be adapted to one another in terms of shape.

If there is no longer an anticipated use, the system 10 can be changed from the live, armed state back into a safe, disarmed state. For this purpose, the blasting cap 1 is moved from the active region of the explosive 3, from the sleeve insert 2, 2'.

The adjustment of the blasting cap 1 can take place through movement of the fuse head 11. This can be achieved through a rotation of the fuse head 11, for example. If the fuse head 11 is turned to the right, for example, the blasting cap 1 moves in the direction of the sleeve insert 2, 2'. A rotation to the left then once again moves the blasting cap 1 out of the sleeve insert 2, 2' accordingly. The connection 16 between the fuse head 11 and the housing 13 in this case is preferably achieved via a thread based on plastic on the fuse head 11 and on the housing 13.

The pressure element 15 which is installed in addition is used to ensure the separation of the blasting cap 1 and, where necessary, the delay element (14) from the explosive 3, particularly when under the influence of heat caused by fire, etc. The functionality and strength of plastics cannot be guaranteed when under the influence of intense heat. If the plastic, and therefore the connection between the housing 13 and the fuse head 11, is softened under the influence of heat and the pressure element 15 presses the fuse head 11 out of the housing 13, the blasting cap 1 should be located in the live position or in the live state.

In a preferred embodiment, the housing 13, the explosive 3 and the sleeve insert 2, 2' form a modular, self-contained unit 20 or 20', in which the fuse head 11 can be received. The fuse head 11 may likewise form a modular unit 21 with the primer cap, the blasting cap 1 and possibly the delay line 14.

What is claimed is:

1. A system comprising a housing, an explosive held in the housing, a fuse head having a blasting cap, and a pressure spring circumferentially disposed about the blasting cap, the housing including a sleeve insert, wherein the fuse head is rotatably connected to the housing via a screw connection, wherein the pressure spring is attached between the fuse head and the housing and configured to separate the blasting cap from the explosive when the screw connection is under the influence of heat, wherein the blasting cap is height-adjustable in the sleeve insert based on a rotation of the fuse head with respect to the housing.

2. The system according to claim 1, wherein the fuse head at least comprises a primer cap.

3. The system according to claim 2, wherein the fuse head includes a delay tube attached to the blasting cap.

4. The system according to claim 3, wherein at least the fuse head, the primer cap, and the blasting cap form a modular subassembly.

5. The system according to claim 2, wherein the blasting cap on a base of the fuse head is insulated therewith.

6. The system according to claim 2, wherein the fuse head includes a delay line between the primer cap and the blasting cap.

7. The system according to claim 1, wherein the sleeve insert delimits the explosive.

8. The system according to claim 1, wherein the sleeve insert has a hollow or empty space in which a separating medium is introduced.

9. The system according to claim 1, wherein the sleeve insert has a cylindrical body with a base and an opening opposite this base.

10. The system according to claim 9, wherein the sleeve insert has a shoulder in the form of a constriction which is introduced in a lower end region of the sleeve insert.

11. The system according to claim 10, wherein the shoulder is conical, truncated conical, pyramid-shaped or cylindrically shaped.

12. The system according to claim 1, wherein the housing, the sleeve insert and the explosive form a modular subassembly.

13. The system according to claim 1, wherein the system is a hand grenade.

* * * * *